US006939172B2

(12) United States Patent
Lu

(10) Patent No.: US 6,939,172 B2
(45) Date of Patent: Sep. 6, 2005

(54) ELECTRICAL CONNECTOR WITH ANTI-MISMATING ARRANGEMENT

(75) Inventor: Yao Pang Lu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/025,187

(22) Filed: Dec. 28, 2004

(65) Prior Publication Data

US 2005/0153600 A1 Jul. 14, 2005

(30) Foreign Application Priority Data

Jan. 8, 2004 (CN) ..... 2004200241584

(51) Int. Cl.[7] ..... H01R 13/648
(52) U.S. Cl. ..... 439/607; 439/70
(58) Field of Search ..... 439/70, 607, 608, 439/680, 681

(56) References Cited

U.S. PATENT DOCUMENTS 5,622,522 A * 4/1997 Tan et al. ..... 439/607
6,243,540 B1 6/2001 Kume et al.
6,371,790 B1 4/2002 Huang
6,379,185 B2 4/2002 Belopolsky et al.
6,398,587 B1 * 6/2002 Chen et al. ..... 439/607
6,471,546 B1 * 10/2002 Zhu et al. ..... 439/607
6,764,338 B2 * 7/2004 Fang ..... 439/607

* cited by examiner

*Primary Examiner*—Thanh-Tam Le
(74) *Attorney, Agent, or Firm*—Wei Te Chung

(57) ABSTRACT

An electrical connector (100) includes an insulative housing (1), a number of contacts (2), a shield (3) and a camera module (4). The insulative housing has a number of passageways (12) defined therein. The contacts are correspondingly received in the passageways. Each contact includes a holding portion (24) engaging with the passageway and securing the contact with the housing, a soldering portion (26) soldering to a Printed Circuit Board, and a contacting portion (23) electrically connecting the camera modules The camera module mounts on the insulative housing, and have a number of contacting sections (430). The camera module also defines a number of hook engaging portions (44), and a projecting portion (420). The shield has a number of hooking portions (35) corresponding to the hook engaging portions and a cutout (37) engaging with the projecting portion. The shield surfacely and peripherally surrounds the camera module.

8 Claims, 7 Drawing Sheets

ELECTRICAL CONNECTOR WITH ANTI-MISMATING ARRANGEMENT

BACKGROUND OF THE INVENTION

1. Field of the Invention

The present invention relates to an electrical connector, particularly to an electrical connector applied in the mobile phones or other electronic equipments.

2. Description of the Prior Art

A conventional electrical connector is described in the U.S. Pat. No. 6,243,540. The conventional electrical connector comprises a lens barrel and a lens hood detachably mounted on the lens barrel. The lens barrel is formed with a first outer circumference portion. The first outer circumference portion has three projected guide rails symmetrically provided thereon. The lens hood correspondingly defines three groove notches. The groove notches each engages with the corresponding guide rail thereby securing the lens barrel with the lens hood.

As is described above, the guide rails are formed symmetrically on the first outer circumference, and the electrical connector has not any anti-mismating designs. So, the lens barrel may be inserted in any directions, which may result in a mismatch in assembly and cause mistakes in electrical connections in farther.

Another conventional electrical connector 100' is shown in FIGS. 6 and 7. The electrical connector 100' comprises an insulative housing 1', a plurality of contacts 2', a shield 3' and a camera module 4'. The insulative housing 1' has a bottom wall and defines a plurality of receiving passageways (not labeled) on the bottom wall. The contacts 2' are correspondingly received in receiving passageways. The insulative housing 1' defines a cavity 10'. The cavity 10' receives the camera module 4' and the shield 3' therein, of which the shield 3' surfacely and peripherally surrounds the camera module 4'. The shield 3' has a plurality of hooking portions 311'. The hooking portions 311' catch the camera module 4' and fix the camera module 4' with the shield 3'. However, the electrical connector 100' has not any anti-mismating designs either, which may cause an incorrect assembly, too. In another hand, when the electrical connector 100' shakes, the camera module 4' may easily be taken away from its normal position. This may cause irreliable electrical connections.

Hence, an improved electrical connector is required to overcome the disadvantages of the prior art.

BRIEF SUMMARY OF THE INVENTION

An object of the present invention is to provide an improved electrical connector with anti-mismating structure.

To achieve the aforementioned object, an electrical connector corresponding to the present invention comprises an insulative housing, a plurality of contacts, a shield and a camera module. The insulative housing has a plurality of passageways defined therein. The contacts are correspondingly received in passageway. Each contact includes a holding portion engaging with the passageway and securing the contact with the housing, a soldering portion extending from the holding portion, and a contacting portion extending from the soldering portion. The camera module mounts on the insulative housing, and a plurality of contacting sections electrically connect the contacts and a projecting portion is provided thereon. The shield is made of conductive material and peripherally surrounds the camera module. The shield defines a cutout.

To compare with the conventional invention, the merit of this invention is the projecting portion. The projecting portion engages with the cutout. Because of the only one projecting portion and the only one cutout correspondingly defined in the shield, the projecting portion is deemed to engage with the cutout in a predetermined way. Such a design can avoid mistakes in assembly thus ensuring a function of anti-mismatch. In another hand, the projecting portion can also prevent the camera module from shaking.

Other objects, advantages and novel features of the invention will become more apparent from the following detailed description of a preferred embodiment when taken in conjunction with the accompanying drawings.

DETAILED DESCRIPTION OF PREFERRED EMBODIMENTS

Figure 3:
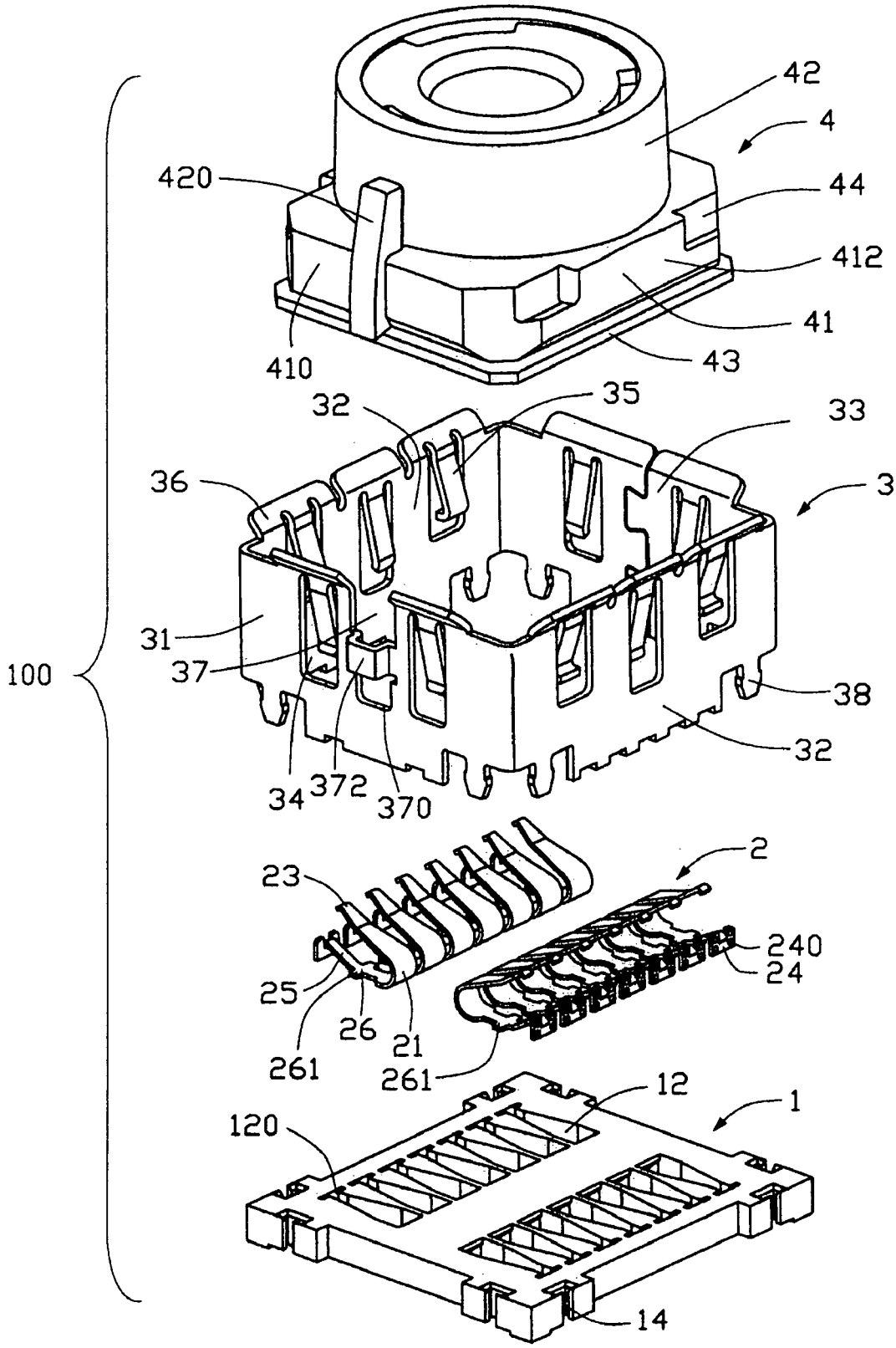
FIG. 3 is an exploded view of FIG. 1.
Figure 4:
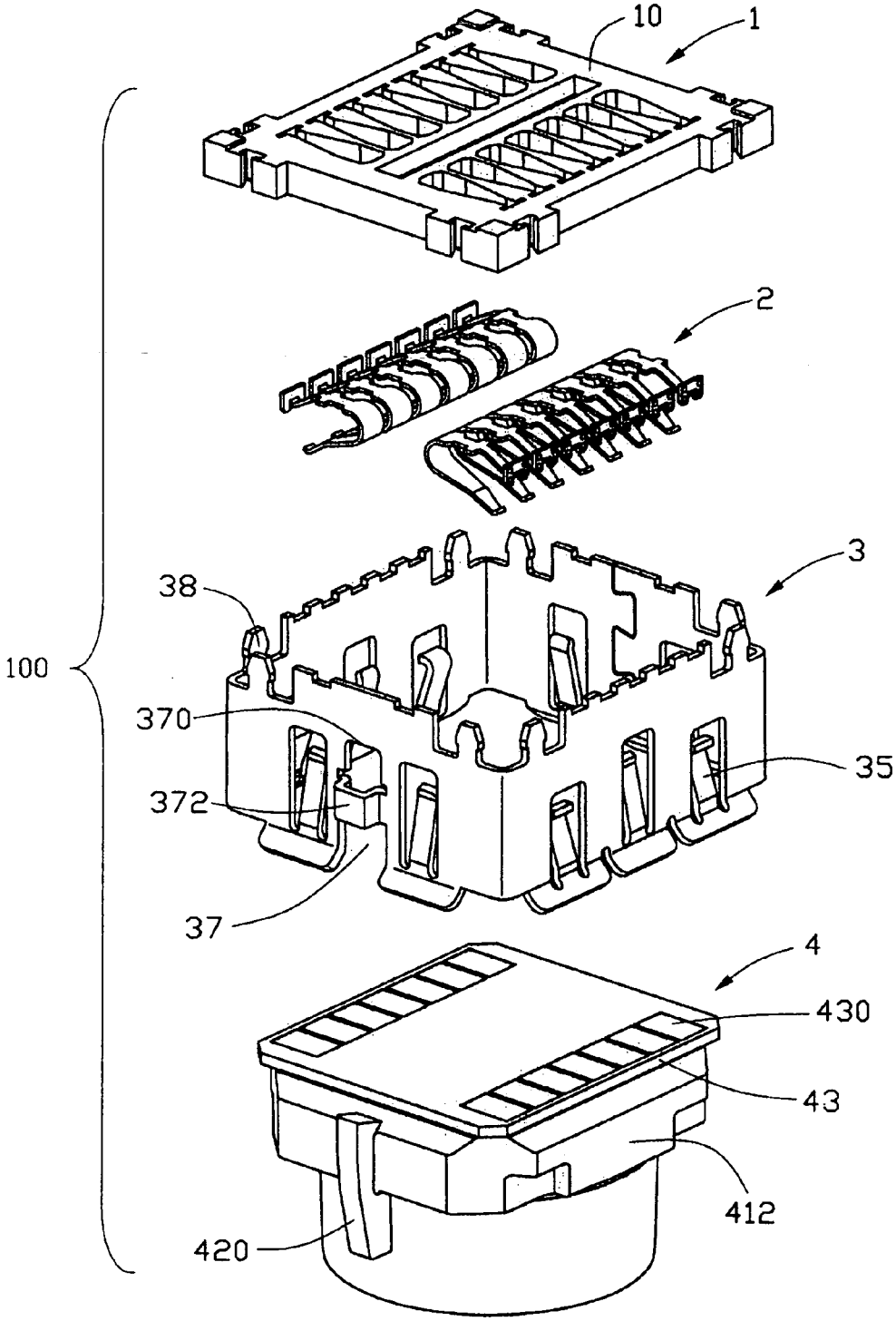
FIG. 4 is an exploded view of FIG. 2.

Referring to FIGS. 3 and 4, an electrical connector 100 in according with the present invention comprises an insulative housing 1, a plurality of contacts 2, a shield 3 and a camera module 4 (an electrical element).

The insulative housing 1 defines a plurality of passageways 12 symmetrically arranged in two rows in the longitudinal direction. A slit 120 is defined in the traverse direction adjacent one of each passageway 12 and communicating with the passageway 12. The insulative housing 1 also comprises a plurality of engaging slots 14 at corner portions and a bottom surface 10 at a lower surface thereof.

Each contact 2 is made of conductive material, and is formed with a U-shaped holding portion 24. The holding portion 24 has a plurality of semi-spherical protrusions 240 projecting from a side face (not labeled) thereof. An extending portion 25 laterally extends from a central part of the U-shaped the holding portion 24. A soldering portion 26 extends from one end of the extending portion 25 in a direction away from the holding portion 24. A connecting portion 21 extends from the soldering portion 26 and then bends upwardly and backwardly. A contacting portion 23 is formed at a free end of the connecting portion 21. The soldering portion 26 has a pair of positioning portions 261 laterally and horizontally extending from a portion adjacent to the extending portion 25. The soldering portions 26 are to be soldered onto a Printed Circuit Board (PCB, not shown).

The shield 3 is formed by bending a punched metal plate. The shield 3 comprises a primary wall 31, a pair of opposite side walls 32 respectively perpendicular to two opposite sides of the primary wall 31, and a combined wall 33 formed by interconnecting two side edges of the metal plate. The shield 3 has a plurality of holes 34 defined in the primary wall 31, side walls 32, and the combined wall 33. A plurality of hooking portions 35 bents downwardly and inwardly towards an inner space of the shield 3 from a free end of the corresponding hole 34. A plurality of guiding portions 36 extends upwardly and outwardly from upper portions of the primary wall 31, side walls 32 and the combined wall 33 to guide the camera module 4 being inserted in. A cutout 37 is defined at a central portion of the primary wall 31. The cutout 37 comprises an abutting edge 370 at a lower portion thereof. The shield 3 also has a clasping portion 372 laterally projecting from the side edges of the cutout 37 and interconnecting opposite side edges of the cutout 37. A plurality of engaging tangs 38 projects downwardly from a lower portion of the shield 3, corresponding to the engaging slots 14.

The electric element employed in this embodiment is the camera module 4, but it may not limited to the camera module 4. The camera module 4 comprises a base 41, a columnar portion 42 extending upwardly from the base 41, and a bottom portion 43 laterally extending in directions from a lower portion of the base 41. The base 41 includes a front wall 410, a pair of opposite adjacent walls 412 and a back wall (not shown and not labeled) opposite to the front wall 410. A plurality of hook engaging portions 44 is defined at the adjacent walls 412 corresponding to the hooking portions 35 formed at the shield 3. A plurality of contacting sections 430 is provided on a lower surface of the bottom portion 43 corresponding to the contacting portions of the contacts. The camera module 4 also has a projecting portion 420 upwardly and laterally extending from a central portion of the front wall 410. The projecting portion 420 extends upwardly until it reaches a half height of the columnar portion 42, and combines with the columnar portion 42.

Figure 1:
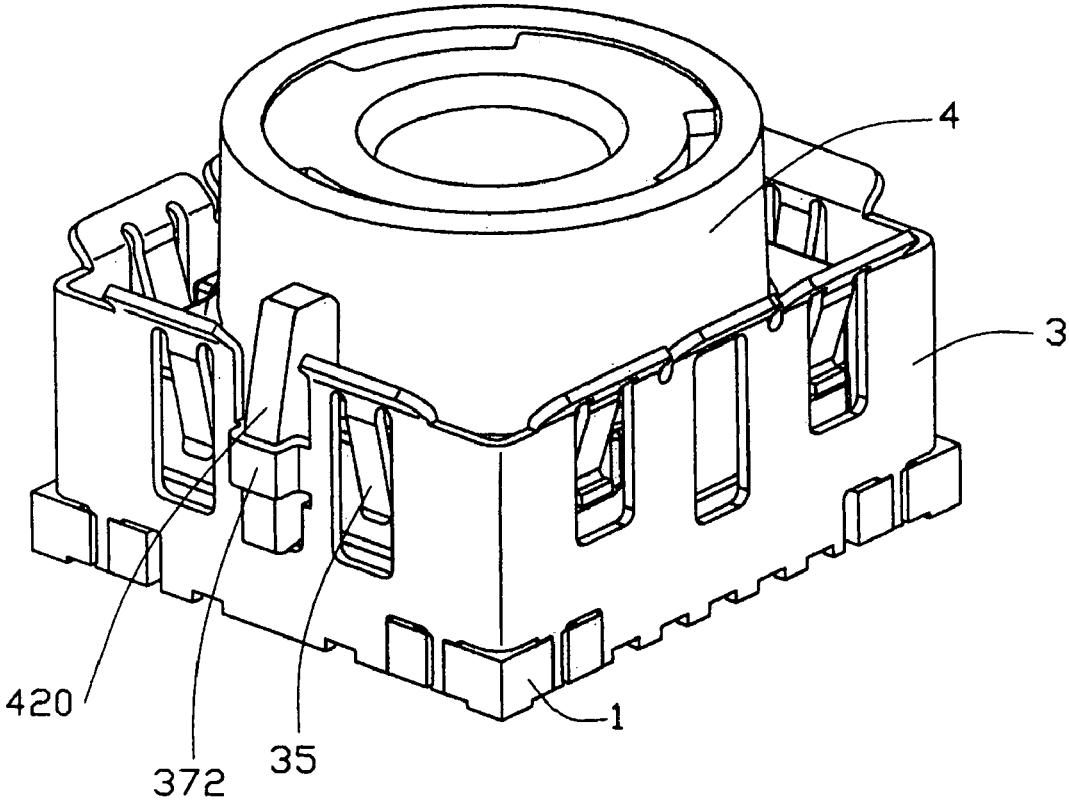
FIG. 1 is a perspective assembled view of an electrical connector corresponding to the present invention.
Figure 2:
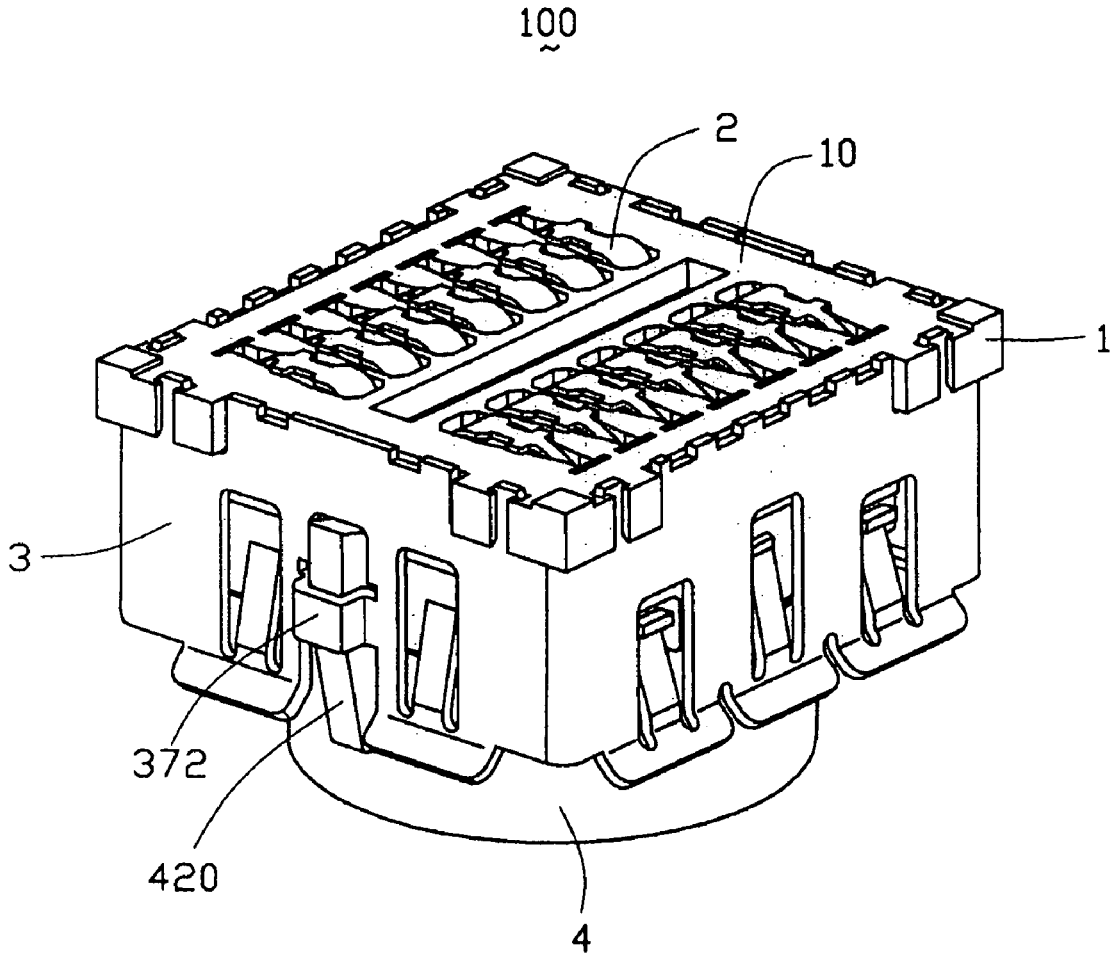
FIG. 2 is another perspective view of the electrical connector showing a bottom surface thereof.
Figure 5:
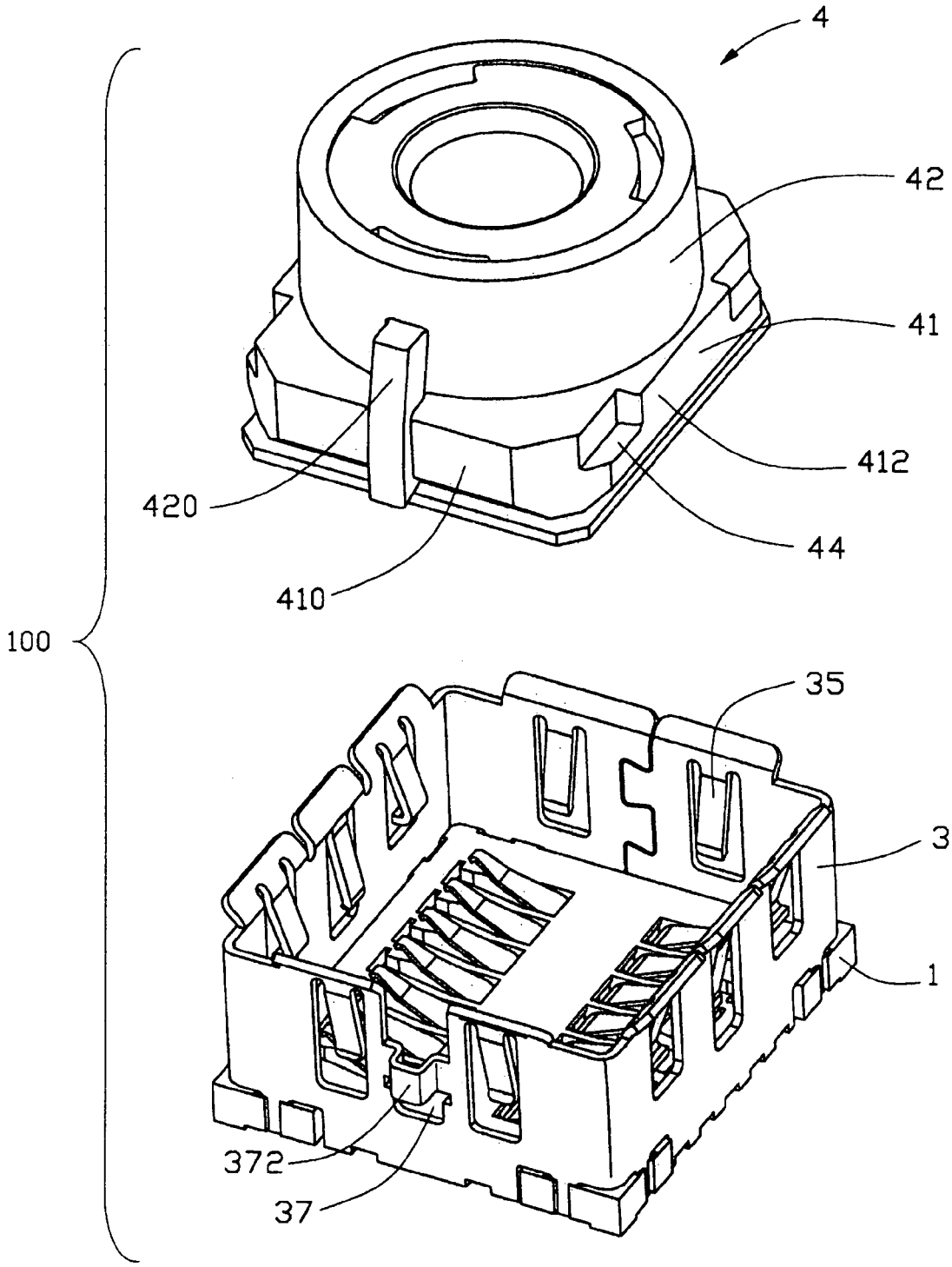
FIG. 5 is a partially assembled view of FIG. 1.
Figure 6:
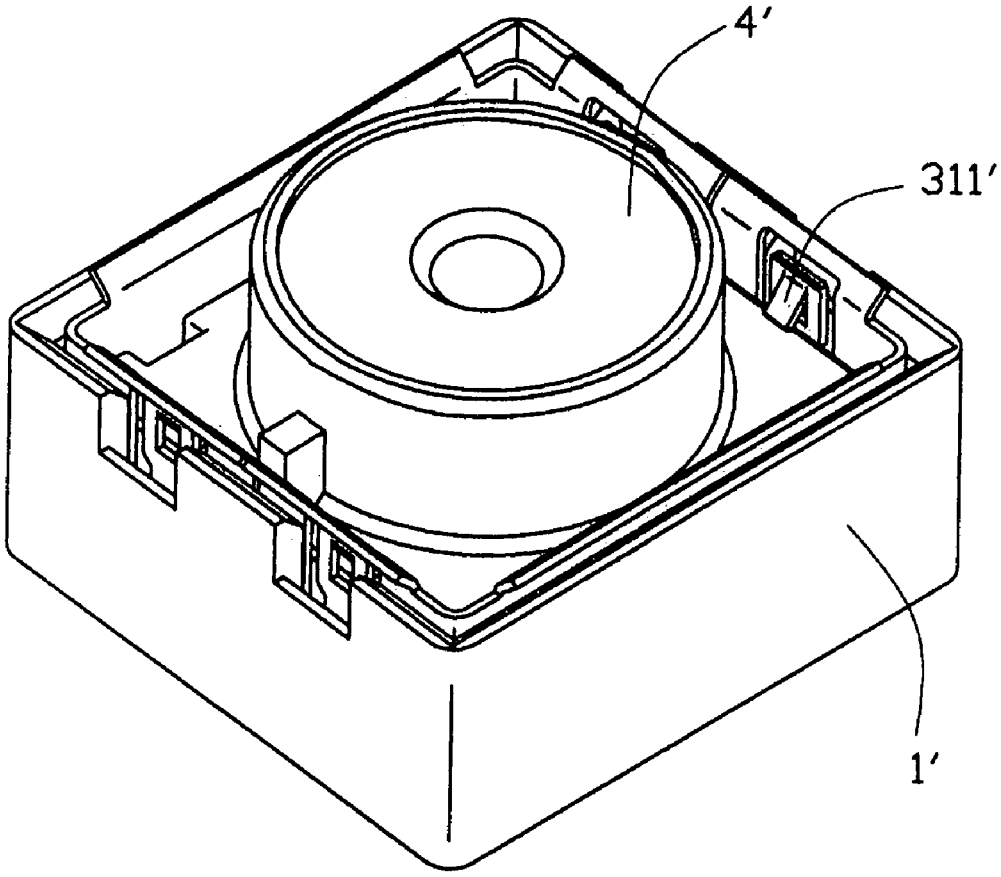
FIG. 6 (PRIOR ART)
FIG. 6 is a perspective assembled view of a conventional electrical connector.
Figure 7:
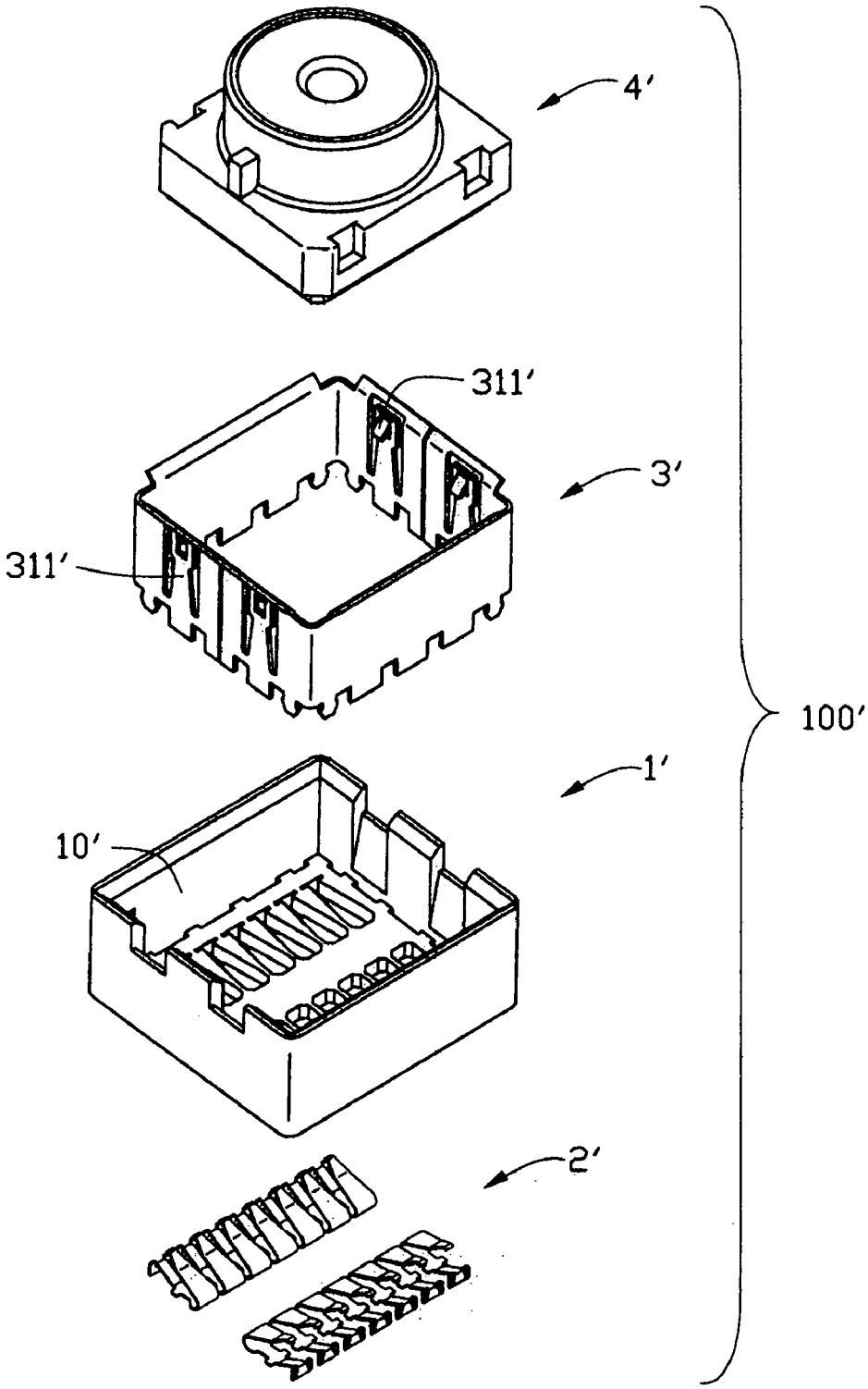
FIG. 7 (PRIOR ART)
FIG. 7 is an exploded view of FIG. 6.

Also referring to FIGS. 1, 2 and 5, in assembly, the contacts 2 are inserted to corresponding passageways 12 in a bottom-to-top direction. The holding portions 24 of the contacts 2 engage with the slits 120. The protrusions 240 have an interference fit with the slits 120 thus securing the contacts 2. The positioning portions 261 of the contacts 2 abut the bottom surface 10 of the insulative housing 1. The shield 3 engages with the insulative housing 1 in an up-to-down manner, of which the engaging tangs 38 are inserted into the engaging slots 14. The engaging tangs 38 engage with the engaging slots 14, thus the insulative housing 1 is fixed to the shield 3. The guiding portions 36 guide the camera module 4 engaging with the shield 3 in an up-to-down manner. When the camera module 4 is guided in, the hooking portion 35 may be pressed and deflected. When the camera module 4 is completely inserted in, the hooking portions 35 may restore to the normal status, and engage with the hook engaging portion 44. The projecting portion 420 corresponds the cutout 37, of which a lower surface of the projecting portion 420 abuts the abutting edge 370 of the cutout 37, the clasping portion 372 clasps the projecting portions 420. When the camera module 4 is fixed, the contacting sections 430 defined at the bottom portion 43 may electrically connect the corresponding contacts 2 received in the insulative housing 1.

When the camera module 4 is guided in, the projecting portion should be placed 420 corresponds the cutout 37. Thus, an object of anti-mismating is achieved, and the incorrect operation, which may result in irreliable electrical connections, may be avoided. In another hand, as the projecting portion 420 is laterally projecting from the front wall 410, and the engagement between the projecting portion 420 and the cutout 37 and the clasping portion 372 may avoid horizontal and vertically shakes of the camera module 4.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein. Especially, the electrical element of the electrical connector 100 is not limited to the camera module 4.

I claim:

1. An electrical connector comprising:

an insulative housing having a plurality of passageways defined therein;

a plurality of contacts correspondingly received in the passageways, each contact comprising a soldering portion, a holding portion engaging with each passageway and securing the contact with the housing, and a contacting portion electrically connecting an electrical element; and a shield made of conductive material and peripherally surrounding the electrical element;

wherein the electrical element mounted on the insulative housing, the electrical element having a base, a bottom portion laterally extending in a direction from a lower portion of the base, and a plurality of contacting sections provided on a lower surface of the bottom portion corresponding to the contacting portions of the contacts;

wherein the base including a front wall and a projection portion upwardly and laterally extending from a central portion of the front wall; and wherein the shield having a plurality of holes defined in a primary wall, a pair of side walls and a combined wall, the shield further having a plurality of hook portions each bends downwardly and inwardly towards an inner space of the shield from a free end of a corresponding hole, a cutout is defined at a central portion of the primary wall, wherein the cutout comprising an abutting edge at a lower portion thereof, and a clasping portion laterally projecting and interconnecting opposite side edges of the cutout.

2. The electrical connector as claimed in claim 1, wherein the insulative housing defines a plurality of engaging slots, and wherein the shield has a plurality of engaging tangs received in the engaging slots.

3. The electrical connector as claimed in claim 1, wherein the each contact has a pair of positioning portions laterally and horizontally extending from the soldering portion.

4. The electrical connector as claimed in claim 1, wherein the shield has a plurality of guiding portions guiding the electrical element being inserted in.

5. The electrical connector as claimed in claim 1, wherein the electrical element has a plurality of hook engaging portions corresponding to the hook portions.

6. An electrical connector assembly comprising:

a shield defining a cavity in a vertical direction;

an insulative housing receiving in a bottom portion of the cavity;

a plurality of contacts disposed in the housing, each of the contacts defining an upper contacting portion exposed outside of the housing;

an electronic module receiving in an upper portion of the cavity and having conductive pads mechanically and electrically connected to the corresponding upper contacting portions of the contacts; and complementary interengaging means formed on the electronic module and the shield, the means including a projection and a cutout engaged with each other when said electronic module is downwardly loaded into the upper portion of the cavity;

wherein the electronic module having a base, a bottom portion laterally extending in a direction from a lower portion of the base and the conductive pads provided on a lower surface of the bottom portion, wherein the base including a front wall and the projection portion upwardly and laterally extending from a central portion of the front wall;

wherein the shield having a plurality of holes defined in a primary wall, a pair of side walls and a combined wall, the shield further having a plurality of hook portions each bends downwardly and inwardly towards an inner space of the shield from a free end of a corresponding hole; and wherein the cutout is defined at a central portion of the primary wall, the cutout comprising an abutting edge at a lower portion thereof and a clasping portion laterally projecting and interconnecting opposite side edges of the cutout.

7. The assembly as claimed in claim 6, wherein the projection and the cutout are further engaged with each other in the vertical direction for providing a stopper function thereof in the vertical direction.

8. The assembly as claimed in claim 6, wherein the hook portions cooperate with engagement between the projection and the cutout to retain the electronic module with regard to the shield.

* * * * *